United States Patent [19]

Scheinman et al.

[11] 4,131,207

[45] Dec. 26, 1978

[54] AUTOMATIC SHEET-STACKING AND TRANSPORT MACHINE

[76] Inventors: Arnold H. Scheinman, 64 Speir Dr., South Orange, N.J. 07079; Ernst Paisker, 81 JFK Dr., Milltown, N.J. 08850

[21] Appl. No.: 741,478

[22] Filed: Nov. 12, 1976

[51] Int. Cl.[2] ..... B65G 57/06

[52] U.S. Cl. ..... 214/6 DK; 93/93 DP; 214/6 H; 214/6 S; 271/189; 271/221

[58] Field of Search ..... 214/6 DK, 6 H, 6 S; 271/189, 192, 218, 221, 233; 93/93 R, 93 DP

[56] References Cited

U.S. PATENT DOCUMENTS

| | | | |
|---|---|---|---|
| 2,220,191 | 11/1940 | Wylie | 214/6 H |
| 2,228,887 | 1/1941 | Peterson | 214/6 H |
| 2,915,950 | 12/1959 | Le Bombard | 271/233 X |
| 3,129,825 | 4/1964 | Lamb | 214/6 H |
| 3,205,794 | 9/1965 | Califano et al. | 214/6 DK X |
| 3,381,829 | 5/1968 | Turner | 214/6 DK |
| 3,447,695 | 6/1969 | Krepp et al. | 214/6 DK |
| 3,688,920 | 9/1972 | Frish | 214/6 H |
| 3,912,254 | 10/1975 | Woodruff | 271/189 X |
| 4,030,621 | 6/1977 | Swanson et al. | 214/6 DK X |

*Primary Examiner*—L. J. Paperner

[57] ABSTRACT

In a preferred embodiment, an automatic sheet-stacking and stack transporting machine, transporting and depositing single sheet-line forms onto free-wheeling machine rollers above an elevator, a limit switch rearwardly located to activate an aligning lever and to retract the free-wheeling machine rollers to thereby drop rollers-supported sheets onto the platform rollers and to further initiate lowering of the elevator platform rollers sufficiently downwardly to break the electrical circuit to terminate the downward movement until a subsequent activation of the limit switch by deposit of another sheet, a maximum stacking load switch mechanism being activatable when the elevator platform rollers have been lowered to a maximum predetermined limit whereupon the elevator lowers to a take-off position at which take-off position interspersed take-off driven rollers transport the aligned stack of sheets from the machine to a distant unloading point, and thereafter the elevator rises upwardly to the original depositing position.

11 Claims, 11 Drawing Figures

AUTOMATIC SHEET-STACKING AND TRANSPORT MACHINE

This invention relates to an automatic sheet-stacking machine, particularly useful in stacking and aligning stacks of cardboard sheeting produced in a series of consecutive sheets from another machine.

BACKGROUND TO THE INVENTION

Prior to the present invention, there has not existed a machine comparable to that of the present invention, there being no fully automatic machine which may be left to operate to both collect, stack, and align, and deliver the stacks to a take-off point beyond the stacking machine. In contrast, conventionally several workers have been necessary to attend the receiving of each of a series of sheets of cardboard produced and delivered on a conveyor, having to thereafter manually stack and manually align and manually transport the same before or after stacking to a suitable off-the-conveyor location, as well as the eventual transport to a shipping or storage location. More recently, a machine was devised which purported to simplify matters, by providing for automatic piling of the sheets one upon the other, but required/requires constant attendance and manual assistance of and by one or more workers to prevent excessive stacking and to align during and after the stacking to prevent hang-ups on the equipment. Thereafter, the stacks had to be manually moved to an out-of-the-way point.

SUMMARY OF THE INVENTION

Accordingly, objects of the present invention include the overcoming and/or avoiding of one or more of the problems and difficulties of the type(s) discussed above, together with novel advantages not heretofore available.

In particular, an object is to obtain complete automation of a series of heretofore complex steps of stacking, aligning, having consistant stack sizes, moving stacks rapidly to removal points, while avoiding simultaneously machine jams, piling-up of unstacked sheets while aligning and/or removing prior-stacked sheets.

Another object is to accomplish the foregoing objects while maintaining low cost of manufacture, simple design of the machine, flexibility of operation thereof, and achieving a high degree of reliability and achieving low maintenance requirements.

Other objects become apparent from the preceding and following disclosure.

One or more objects are obtained by the invention as illustrated in the following typical and preferred embodiments.

Broadly the invention may be defined as a machine having a stacked-sheet support, and a feed mechanism for automatically delivering and aligning and stacking sheets of substantially rigid material such as cardboard, onto the stacked-sheet support.

Preferably there is included as a part of the feed mechanism, an aligning device which aligns forward and rearward edges of the consecutively feed sheets each before depositing upon the stacked-sheet support.

There is provided a preferred series of consecutive driven rollers which transport and feed one at a time sheets to a high point at the aligning device-position.

At the base of the stacking position, there is provided an automatically initiatable take-off mechanism for transport to a distant removal point and return of the stacked-sheet support to its sheet-receiving position during a timer-predetermined period, in this preferred embodiment thus avoiding delay and interruption of the stacking procedure and process and operation.

The above-noted aligning device in a more preferred embodiment thereof, becomes activated by virtue of a limit switch activated by pressure of a forward edge of the newly-fed sheet, causing the aligning device to flip-up an aligning arm behind the sheet to press-forwardly the sheet to a forward stop or barrier, after a timer-set period the aligning arm retracting to its pre-activation state and position, before which the aligned stack will have been deposited at the stacking position by retraction of preferred retractable rollers heretofore supporting the sheet during the aligning, after which the rollers return to the extended supporting locations and positions. These rollers are typically and preferably free-wheeling, not necessarily driven since the force of the forward movement of the sheet during delivery carries the sheet fully onto these rollers. Additionally, there is a drop in alignment preferably of the subsequently-occurring rollers, and also a back-up projection slightly elevated, over which the sheet passes but drops beyond onto subsequent lower rollers, and is thus prevented from shifting rearwardly.

Preferably upon activation of the sensor element, the stack-aligned sheets become lowered a predetermined distance by activation of a lowering elevator mechanism of the stacked-sheet support until a biased lever (maintaining electrical closed-circuit) is relieved of pressure by the deposited sheet as the lowering moves the sheet below and past the lever, at which point pressure is relieved thus allowing the biased lever to break electrical circuit to thus terminate the lowering action. Upon reaching another predetermined limit of (load of) stacked sheets, the lowering action of the stacked-sheet support trips a toggle switch preferably, to cause the elevator lowering action thereof to proceed to a maximum lower take-off position at which point the take-off mechanism becomes activated for take-off, and a timer switch concurrently activated thereafter upon expiration of the take-off period causes the stacked-sheet support to rise to the predetermined position below the aligning position. When the stacked-sheet support during lowering to the take-off position reaches that position, a switch turns-off the lowering mechanism. As the stack-sheet support rises to the stacking position, a switch is automatically flipped to turn-off the elevating motor drive. During the take-off, take-off rollers motor(s) is/are activated in association with a timer switch, whereby after a period of time has expired sufficient for the stacked sheets to be removed from the stacking machine away from the stacked-sheet support, the take-off rollers motor(s) are automatically turned-off.

In a more preferred embodiment, the stack-sheet support is inclusive of a series of free-wheeling aligned-parallel support rollers, positioned for rolling a stack of sheets in a direction from forwardly to rearwardly, and the mounting thereof are such that the parallel support rollers are, at the take-off position, recessed below the driven rollers of the take-off mechanism.

Another particular advantage of the machine lies in the adjustability of a lateral wall within the machine, such that the side wall also serves as an aligning structure, adjustable to the particular size of the sheet. In conjunction therewith, there is provided a rack and pinion for moving the entire machine laterally to and fro, to desired sheet-receiving positions relative to the feed driven rollers; this can be advantageously coordinated with the adjustable lateral wall within the machine for a multitude of sheet-sizes and of feed machines and feed rollers or conveyors, as the case may be.

The invention may be better understood by making reference to the following Figures.

THE FIGURES

DETAILED DESCRIPTION

Figure 1:
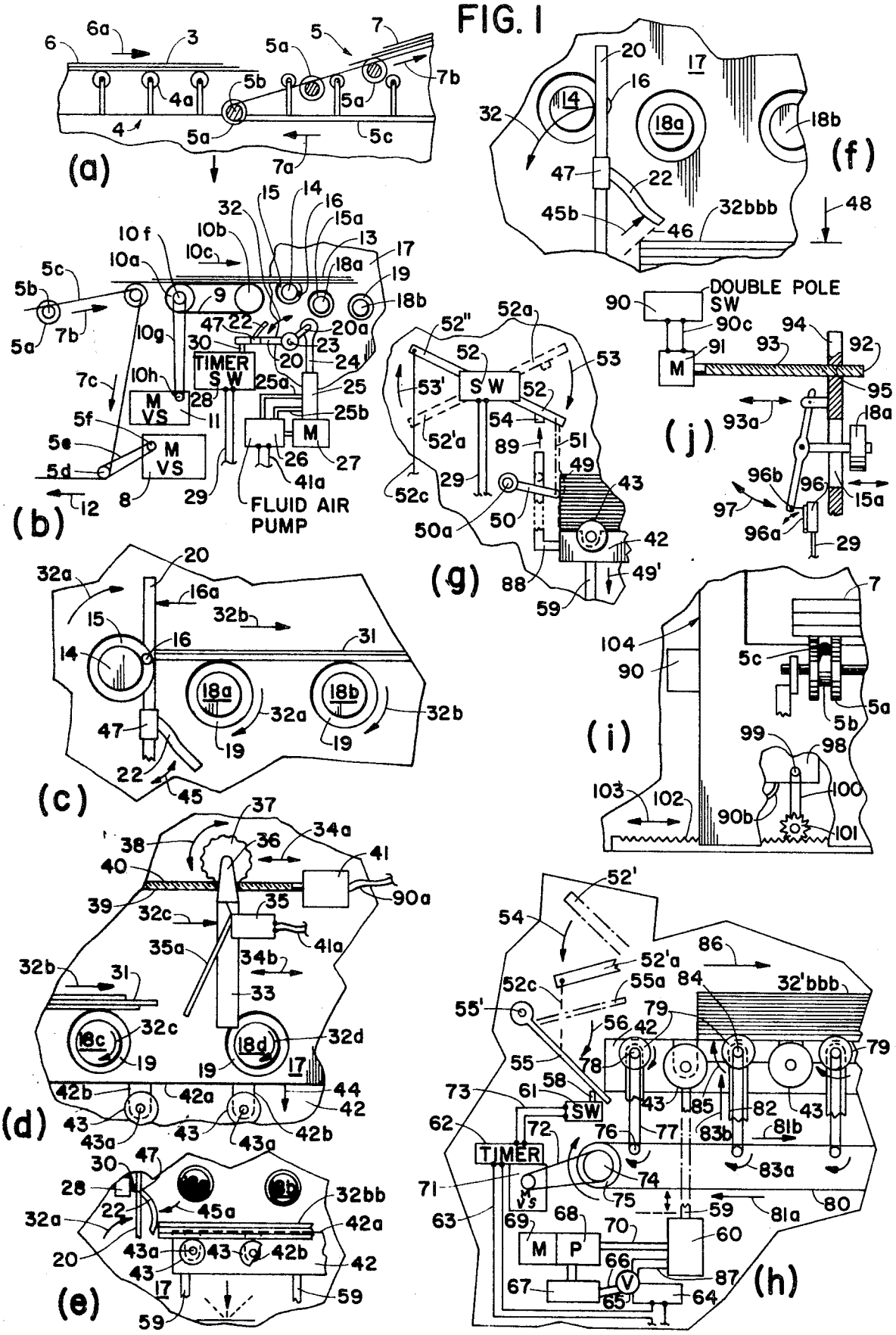
FIG. 1 is composed of sub-figures (*a*) through (*j*), all of which are diagrammatic and are intended to be substantially in flow series in the nature of a flow chart, depicting not only the machine itself, but also the various stages of its operation in the stacking of sheet material.

With reference to FIG. 1(*a*), a stack (unaligned) of several sheets 6 are moved in direction 6a along rollers 4a of roller device 4, toward driven roller system 5 typically having driven rollers 5a, 5b, and belt portion (cable portion) 5c moving in direction 7a to move another stack (unaligned/non-aligned) in direction 7b.

In FIG 1(*b*), the belt/cable portions respectively may be seen moving in directions 7b and 7c for example, returning around drive roller 5d, driven by belt 5e from drive gear 5f of variable speed motor 8. Belt 9 is driving conveyor roller 10b to move an unaligned stack 13 in direction 10c, the conveyor roller 10a driving the belt 9 and being driven through gear 10f by drive belt 10g from drive gear 10h of variable speed motor 11. The unaligned stack 13 moves over free-wheeling roller 14 above the dead-man (rearward rebound absorber projection) 16 which prevents the unaligned stack from rebounding rearwardly beyond that point. The rollers 14 18a and 18b project from holes 15, 15a, and 18a, for example, of side wall 17.

Aligning presser arm 20 is pivotally movable in to and fro directions 32 on pivot pin 23 when actuation arm 20a is moved alternately upwardly and downwardly by piston arm 24 of piston cylinder 25 with its ejection and retraction fluid conduits 25a and 25b connected to pump 26 driven by motor 27 responsive to flow-control signals of electrical leads 41a. In the retracted state of FIG. 1(*b*), the lever presser arm 20 presses circuit-breaking button 30 to timer switch 28, and upon activation of the aligning presser arm 20 to an upright position so as to simultaneously relieve pressure on the button 30, the circuit (electrical) of switch 28 becomes closed to send a signal by the leads 29 to rollers-retraction solenoid 96 of FIG. 1(*j*). The presser-arm 20 carries (mounts) a switch 47 and lever 22 thereof illustrated in detail in FIG. 1(*f*).

The FIG. 1(*c*) illustrates an enlarged section of the FIG. 1(*b*) disclosure, and represents a further stage in the machine operation. FIG. 1(*c*) shows the machine in the act of "aligning" the previously non-aligned stack, by virtue of the aligning presser arm 20 having flipped-up against the rearward edges of the sheets of the non-aligned sheet to thereby urge the same forwardly beyond roller 14 and past the deadman projection 16, onto the free-wheeling rollers such as rollers 18a and 18b in movement in direction 32b for the thereby aligned stack 31, the rollers 18a and 18b turning in respective directions 32a and 32b. The lever 22 is again shown, together with the path of potential travel 45 from its biased present position.

FIG. 1(*d*) illustrates the state of the stack before the aligning has been effected, to the right of the FIG. 1(*c*) view — i.e., further forwardly in the direction of movement 32b before becoming pressed against the adjustable barrier wall 33 and the limit switch 35 and its sensing arm 35a which when pressed toward the barrier wall 33 closes electrical circuit to send a signal by leads 41a as also shown in the preceding FIG. 1(*b*). It is further indicated that the stack of sheets may be caused to travel (roll) in direction 32c up to the barrier wall 33, which wall is adjustably movable to and fro in directions 34b. The illustrated rollers 18a through 18d are typically represented collectively as within wall holes 19. Rollers 18c and 18d are represented as rotating in directions 32c and 32d respectively. It is also represented that activation through leads 90a control direction and movement by motor 41 of the screw-lever (gear) 40 acting upon the rotatable gear 37 from which suspension structure 36 mounts the barrier wall 33, of the barrier wall 33, the screw-lever 40 having screw threads 39. Also, illustrated for the first time, is the elevator stacked-sheet support-frame 42a mounting under-slung rollers 43 on downwardly-extending support arms 42b by pins 43a, the side elevator support frame wall 42 being also illustrated. The support frame and rollers 43 thereof are caused to move downwardly in direction 44 intermittently after the aligned stack is deposited thereon.

FIG. 1(*e*) illustrates that downward movement after the depositing, while the deposited aligned stack 32bb is still pressing downwardly the lever 22. The elevator structure 42 is shown to be elevated and lowered by virtue of supporting hydraulic lift piston arms and supports 59. In illustrating the downward direction of travel, there is shown the termination point of such travel, which would correspond to the point at which the stack 32bb would have moved-past the lever 22 thereby permitting the lever 22 to again flip-up to thereby open electrical circuit to terminate the lowering of the hydraulic pistons 59.

FIG. 1(*f*) illustrates this flipping-up of lever 22 in return-direction 45b past the now stationary aligned and supported stack 32bbb the top of which has had its downward movement terminated as shown by arrow 48.

FIG. 1(*g*) illustrates another switching mechanism in which as the elevator structue 42 has been intermittently moved downwardly, it has eventually physically engaged and flipped downwardly a toggle switch lever 50 causing it to pivot within arc 49 to turn-on (close electrical circuit) the elevator-lowering hydraulic motor and valve to over-ride any cut-out until the elevator structure 42 has reached a predetermined lower stop-point after moving continuously downwardly in direction 49'; the flipping downwardly of the lever 50 serves by connector 51 to flip-down the toggle-switch lever 52 and thus flip-up the lever 52" to pull upwardly the connector 52c which thereby pulls upwardly the lever arm 55 of FIG. 1(*h*), which lever arm 55 becomes pressed against the actuation button 58 to switch 73 when the elevator structure 42 presses downwardly upon lever arm 55, to thereby break-circuit to terminate downward movement of the elevator structure.

FIG. 1(*g*) further illustrates that a lever projection 88 aligned with abutment 54 of lever 52 presses and pushes the lever 52 to position 52a, and lever 52" to position 52'*a*, when the elevator structure 42 rises at the end of the timing cycle of activated timer switch 62 which terminated downward movement and after a predetermined period initiates upward movement; by variable speed motor 71 activated when the downward movement of elevator structure 42 is terminated, the drive belt 80 moves in direction 81*a* (FIG. 1(*h*) ) and 81*b*, as driven through the gear 74 and drive wheel 75, to drive the gears 76 and their respective belts 77 which drive belt-driven gears 78 to thus revolve take-off rollers 79 in directions 85 to take-off the stack 32'*bbb* in direction 86 as the rollers 79 roll on pins 84. Movement upwardly of the left side of the belt 77 is indicated at direction 83*b*. The pins 84 are mounted on appropriate base support structure 82. The lever positions 52'*a* and 52' are further illustrated, as well as the hydraulic system for the elevator being illustrated. Hydraulic cylinder 60 is driven through conduits 87 and 70 in alternate piston directions, as controlled through valve 65 which is regulated by solenoid 64, with the pump 68 being driven by motor 69, and flow being directed to and from vessel (liquid container) 67. An arrow indicates that from the illustrated terminated travel point the piston of the hydraulic system travels alternately upwardly.

FIG. 1(*i*) illustrates that the entire machine is movable sidewardly, laterally in direction 103 upon a track 102 by a driven pinion gear 101 driven through a drive chain 100 by gear 99 of motor 98 having leads 90*b*. Also illustrated is the slotted driven roller 5*b* (see FIG. 1(*a*) ) driven by contacting cable 5*c* on the slotted surface 5*b*, roller 5*a* supporting and transporting stack 7.

Figure 2:
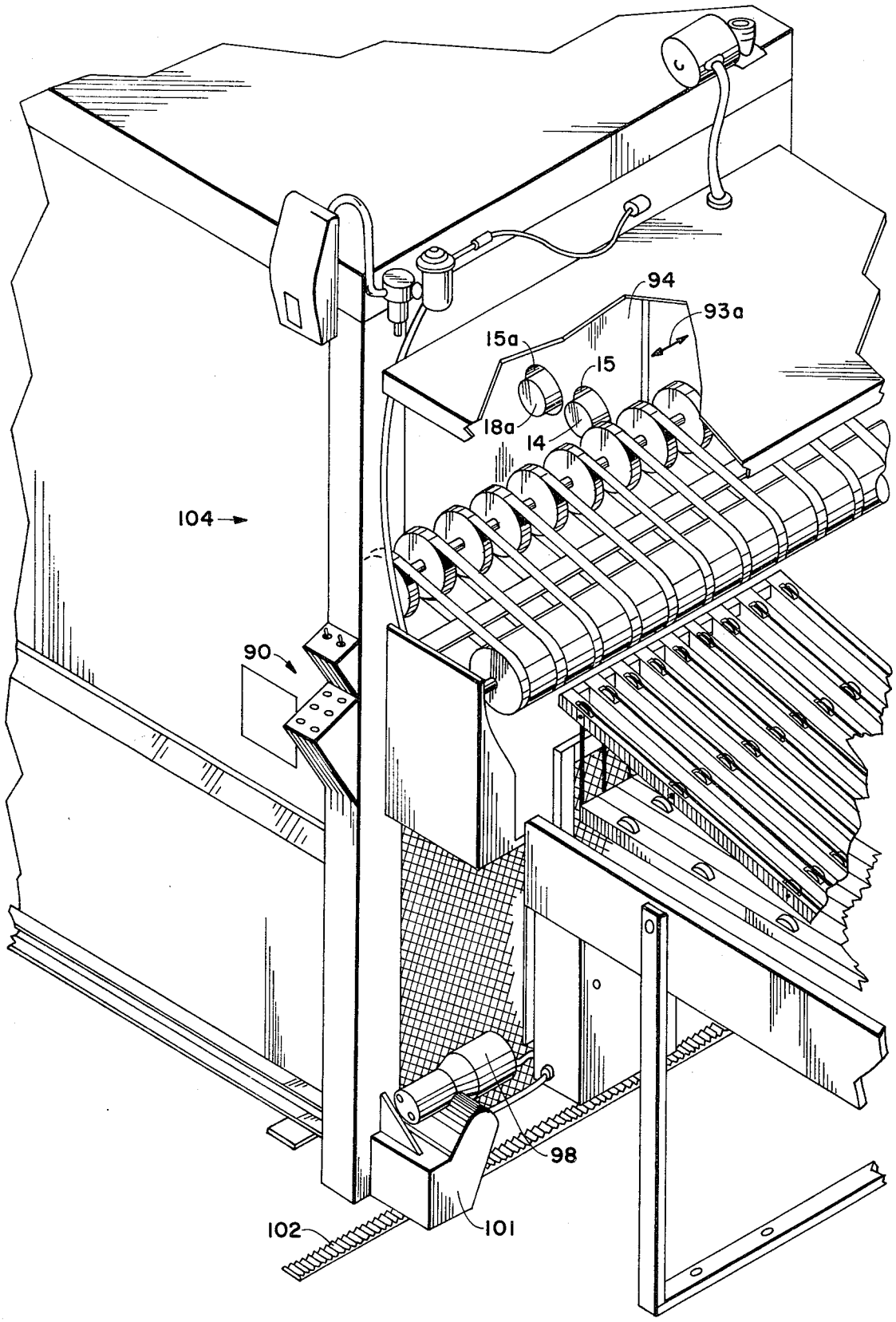
FIG. 2 illustrates an in-part front-side perspective view of the machine in a preferred embodiment, with partial cut-away.

FIG. 1(*j*) illustrates a wall 94 shown in the FIG. 2, illustrating the mechanism of lateral to and fro movement thereof as well as illustrating the mechanism of retraction and extension of rollers 18*a* through hole 15*a* by solenoid activation of solenoid 96 to flip-out arm 96*a* pivotally to thus push outwardly the lever distal point 96*b* in directions 97 thus retracting the roller, a reversal of current ejecting the rollers, through electrical leads 29. The lever (screw lever) 92 has screw threads 93 and revolves within female threads 95 as driven by motor 91 controlled by double-pole switch 90, to move the wall 94 laterally to and fro in directions 93*a*.

FIG. 2 illustrates the more typical appearance of the actual machine as it exists, this machine being fully operational and achieving the afore-stated objects and advantages. No new elements are identified, but numerous of the previously identified elements are viewable in this Figure, and are readily apparent.

It is accordingly within the scope of the present invention to make such variations and modifications and substitution of equivalents as would be apparent from this disclosure, to a person of ordinary skill in this field.

We claim:

1. An automatic sheet-stacking machine, comprising in combination:a stacking support means having a predetermined stack-receiving position for intermittently receiving in series consecutive aligned stacks of sheet-like items as an aligned single-combined stack of increased height; elevator means including a stacking support platform adapted to receive an aligned stack of the sheet-like items at said stack-receiving position, the elevator means being for moving the stacking support platform upwardly and downwardly and for a lowering of the stacking support platform when a sheet-like item is deposited thereon, to a predetermined extent of lowering, and for further additionally lowering the stacking support platform to a lower take-off position as a further-lowering signal becomes activated by the stacking support platform during the stacking support platform lowering toward the lower take-off position; and elevator switching means including a first switch means and a second switch means, a lever means adapted to be contacted by said stacking support platform and operatively connected to both said first and second switch means, the first switch means being first activatable by contact thereof with said stacking support platform when said stacking support platform moves upwardly, said first activatable thereby setting said elevator means to thereafter move downwardly the stacking support platform as intermittently responsive to receipt of each one of said consecutive aligned stacks, and the second switch means being second activatable by contact thereof with said stacking support platform when said stacking support platform moves downwardly to said lower takeoff postition, said second activatable thereby setting said elevator means to thereafter move upwardly the stacking support platform to said predetermined stack-receiving position.

2. An automatic sheet-stacking machine according to claim 1, in which said support platform comprises a plurality of rollers spaced-apart from one-another positioned for moving a sheet-like item from forward to rearwardly in direction, and in which the take-off means includes a series of parallel rollers spaced-apart positioned such that said series of parallel rollers are located substantially alternately between consecutive ones of said plurality of rollers of the support platform when the support platform is at said take-off position, the plurality of rollers of the support platform being recessed below said series when at said take-off position, said series of rollers being driven rollers, and including as a part of the take-off means a driving motor connected to drive said series of rollers to move an aligned stack of sheet-like items during said take-off period.

3. An automatic sheet-stacking machine of claim 1, additionally including feed means for effecting a single combined stack from a series of separately deposited separate aligned stacks, the feed means including an aligning means to align combined stacks into a single aligned combined stack, in which said aligning means includes a sensor element and a presser-arm means for becoming actuated upon activation of the sensor element, and the presser-arm means being such that upon said actuation a single combined stack becomes aligned into said aligned single-combined stack, said sensor element being positioned to be activated as one of said series of consecutive aligned stacks reaches said predetermined stack-receiving position.

4. An automatic sheet-stacking machine according to claim 3, in which said presser-arm means includes a flip-up presser-arm which flips-up against a back edge of a sheet-like item, when a driving mechanism thereof is activated upon activation of said sensor element, and in which the presser-arm means further includes an aligning timer switch means for automatically breaking circuit at an end of a predetermined time period and thereupon causing the flip-up presser-arm to become retracted to an inactivated state and position.

5. An automatic sheet-stacking machine, of claim 3, in which the feed means further includes retractable support means for conveying said consecutive aligned stacks, one at a time in linear series, to said predetermined stack-receiving position, adapted to support said one at a location spaced-above a stacking support platform and spaced-above a top of any previously dropped one of said consecutive aligned stacks, such that upon retraction of the retractable support means said one becomes dropped when said presser-arm means completes alignment of said one at said predetermined stack-receiving position, to thereby begin or add to said aligned single-combined stack on said stacking support means.

6. An automatic sheet-stacking machine of claim 5, in which said retractable support means includes substantially oppositely-spaced-apart separate linearly arranged two series of rollers adapted such that one series of rollers supports an undersurface of said one at one side edge of the one, and an other series of the two series supports an undersurface of said one at the other remaining side edge of the one whereby when the two series of rollers are retracted, said one becomes dropped.

7. An automatic sheet-stacking machine, according to claim 6, in which the feed means includes an aligning means for effecting a stack-aligned position of a sheet-like item after delivery thereof to the stack-receiving position and substantially before said depositing.

8. An automatic sheet-stacking machine of claim 1, additionally including feed means for advancing lineally said series of consecutive aligned stacks lineally one at a time to said predetermined stack-receiving position, and further for causing said one to drop substantially vertically from said predetermined stack-receiving position, and further for aligning a plurality of said series after two or more of said series has been dropped on top of one-another from said predetermined stack-receiving position.

9. An automatic sheet-stacking machine of claim 8, including a take-off timer switch means for terminating downward lowering of said stacking support platform at said lower take-off position, and for initiating a stack take-off means, and further for initiating raising of the stacking support platform after a predetermined take-off period; and a stack take-off means for conveying automatically said aligned single-combined stack from said stacking support platform at said take-off position during said predetermined take-off period.

10. An automatic sheet-stacking machine of claim 9, in which said stack take-off means comprises a series of driven rollers which have upper extremities thereof at an elevation above supporting surfaces of said stacking support platform when said stacking support platform is positioned at said take-off position.

11. An automatic sheet-stacking machine of claim 10, and feed means including an aligning means for effecting said single combined stack, said aligning means including a sensor element and a presser-arm means for becoming actuated upon activation of the sensor element, and the presser-arm means being adapted such that upon said actuation, a single combined stack becomes aligned into said aligned single-combined stack, said sensor element being positioned to be activated as one of said series of consecutive aligned stacks reaches said predetermined stack-receiving position, and said feed means further including retractable support means for conveying said consecutive aligned stacks, one at a time in linear series, to said predetermined stack-receiving position, adapted to support said one at a location spaced-above a stacking support platform and spaced-above a top of any previously dropped one of said consecutive aligned stacks, such that upon retraction of the retractable support means said one becomes dropped when said presser-arm means completes alignment of said one at said predetermined stack-receiving position, to thereby begin or add to said aligned single-combined stack on said stacking support means.

* * * * *